United States Patent [19]

Golden

[11] 4,391,481

[45] Jul. 5, 1983

[54] CHILD-PROOF ELECTRICAL PLUG SHEATH

[76] Inventor: Theodore A. Golden, 755 W. Big Beaver Rd., Suite 211, Troy, Mich. 48084

[21] Appl. No.: 249,198

[22] Filed: Mar. 30, 1981

[51] Int. Cl.[3] ..... H01R 13/44

[52] U.S. Cl. ..... 339/42

[58] Field of Search ..... 339/42, 45, 46, 60

[56] References Cited

U.S. PATENT DOCUMENTS

| | | | |
|---|---|---|---|
| 2,037,630 | 4/1936 | Hudson | 339/60 R |
| 2,458,153 | 1/1949 | Festge | 339/42 |
| 2,499,825 | 3/1950 | Haulicek | 339/60 R |
| 2,719,956 | 10/1955 | Leighton | 339/60 R |
| 3,683,315 | 8/1972 | Kelly | 339/42 |
| 3,763,457 | 10/1973 | Whippo | 339/42 |

*Primary Examiner*—Joseph H. McGlynn
*Assistant Examiner*—Timothy V. Eley
*Attorney, Agent, or Firm*—Cullen, Sloman, Cantor, Grauer, Scott and Rutherford

[57] ABSTRACT

A thin wall, resilient, generally tubular shaped sheath is fitted over a conventional electrical outlet plug and extends the length of the plug prongs. The sheath forms a barrier wall around the prongs in the space between the plug body and the conventional wall-type receptacle into whose openings the prongs are normally inserted. The sheath resiliently collapses endwise when the plug prongs are inserted within the receptacle openings, and resiliently returns to its normal shape when the prongs are withdrawn. Consequently, the wall formed around the prongs by the sheath, at all times prevents child contact with partially exposed, electrically energized prong portions.

1 Claim, 9 Drawing Figures

CHILD-PROOF ELECTRICAL PLUG SHEATH

BACKGROUND OF INVENTION

The invention herein relates to the provision of a barrier wall which surrounds the prongs of an electrical outlet plug for preventing a small child from contacting the prongs at a time when they may be electrically energized.

Conventional electrical outlet plugs typically are formed of a plug body which may be roughly semi-spherical in shape. Two or three prongs typically extend from the flat face of the plug body. An electrical wire may extend through an opening into the center of the curved portion of the body, for physical connection, by clamps or screws, to portions of the prongs located within the body. The physical shape and size of the body may vary, depending upon the particular kind of electrical plug used.

In some plugs, the wire may come in to the plug from a different direction than that set forth above. in other plugs, two prongs are used and in other plugs, an additional grounding or third prong may also be used. The foregoing electrical plugs are conventional. Although there are variances in sizes, shapes, and general constructions, in essence, all include a plug body, two or three prongs, and an electrical wire entering into the body for connection to the inner ends of the prongs.

Such electrical outlet plugs ordinarily are plugged into wall-type sockets or receptacles which have two or three sockets or openings to receive the corresponding plug prongs. The receptacle member or body ordinarily is secured within the wall of a supporting structure. Usually a face plate is positioned over the exposed portion of the receptacle body to cover the adjacent wall surface and any spaces which may otherwise appear between the wall surface and receptacle body.

The receptacle ordinarily is connected by wires to the electrical system within the wall or structure for energizing the receptacle. Thus, when the prongs of the plug are inserted into the openings or slots in the receptacle, electrical contact is provided for transmitting electricity through the plug wire to the electrically energized device connected to the opposite end of the wire.

In ordinary electrical plug-receptacle combinations, the plug is closely fitted against the receptacle exposed face or the receptacle cover plate face, as the case may be, so that the prongs are concealed within the openings or slots in the receptacle. However, while the plug is inserted or removed, or is partially inserted, portions of the prongs are exposed while the prongs are still electrically energized. Ordinarily, an adults fingers are too large to contact the partially exposed, still energized, prong portions. However, a small child, particularly a very young toddler, may get its fingers into contact with the exposed prong portions of a loosely or partially engaged plug or during the time the plug is being dislodged from the receptacle. Thus, the child may be exposed to an electrical shock which can be severe in the case of a very young child. Also, a child (or adult) may place something (bobby pin, etc.) against the prongs and be burned.

Where electrical wall receptacles are exposed, without plugs engaged therein, cover devices have been utilized to cover or conceal the slots so that a child's fingers cannot engage within the slots to produce an electrical shock. However, such types of covers are not feasible where a plug is partially engaged within the receptacle. Thus, the invention herein is concerned with a means for covering and concealling partially exposed electrical plug prongs to prevent child contact therewith, while the prongs are still electrically energized.

SUMMARY OF INVENTION

The invention herein concerns the formation of a sleeve, or sheath formed of a resilient, tubular-shaped member which surrounds, and which may be frictionally mounted upon a typical, conventional electrical outlet plug. The sleeve extending parallel to and surrounding the prongs of the plug. The sleeve wall is thin and resilient, so that it collapses longitudinally upon the application of pressure against its exposed edge. Thus, insertion of the prongs into a receptacle, provides pressure between the wall portion surrounding the receptacle and the free end of the tubular member. This causes the tubular member to collapse, such as by spreading radially, or by collapsing in an accordian-like fashion endwise, or the like.

The tubular protective member continuously surrounds and provides a continuous barrier wall around the prongs, even when the prongs are partially exposed. That is, as the prongs enter the receptacle slots, the collapsing tubular member still maintains a continuous barrier around the exposed portions of the prongs. Likewise, during the time of removal or during partial insertion of the plug prongs in the receptacle, the endwise expanding tubular member maintains a continuous protective wall.

One object of this invention is to provide a simple, inexpensive attachment which may be easily slipped over a conventional electrical outlet plug and which will resiliently or frictionally grasp against the plug and remain in position for providing a protective wall around the prongs. The protective device may be in the form of a bell-like shape or thimble-shape, which may be resiliently stretched over the typical electrical outlet plug for frictionally grasping the plug surface and thereby mounting the member upon the plug.

Another object of this invention is to provide a child-proof protective wall around exposed electrical plug prongs, wall device can be easily installed, without tools or special skills, and can be kept and used for as long as desired and is of a sufficiently inexpensive construction so that it may be discarded when not needed.

These and other objects and advantages of this invention will become apparent upon reading the following specification, of which the attached drawings form a part.

DETAILED DESCRIPTIONS

Figure 1:
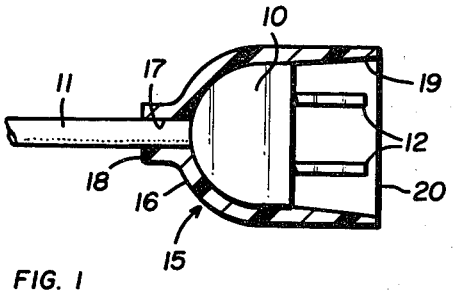
FIG. 1 is an elevational view of a conventional electrical outlet plug with the protective sheath, shown in cross-section, mounted thereon.
Figure 2:
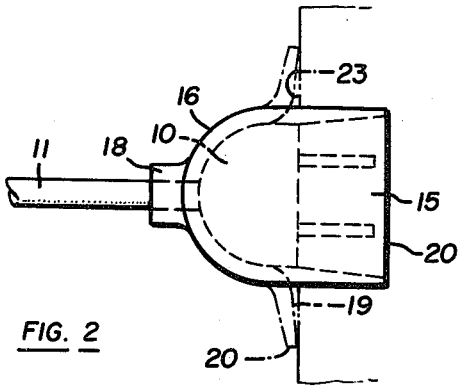
FIG. 2 is an elevational view, similar to FIG. 1, showing the sheath mounted upon a plug, and with the sheath shown in radially expanded, collapsed position in dotted lines.

Referring to FIGS. 1–4, inclusive, the electrical outlet plug illustrated is of the conventional type which is generally semi-spherical in shape. The actual shape and curvature of the plug is immaterial. However, the plug body 10 is illustrated as being attached to an electrical wire 11 which extends into the center of the curved portion of the plug for connection, within the plug body, to the interior of electrical contact prongs 12. The connection of the prongs to the wire is not illustrated since this is conventional and is irrelevent to the invention herein. Ordinarily, the conventional electrical plug has either two or three prongs, depending upon whether it has a ground connection. The prongs themselves may be either straight and flat or curved in cross-section. In some cases, the prongs may be non-uniform in cross-sectional shape. The exact shape of the prongs, is not material.

The child-proof protective sheath 15 is illustrated as being formed in a generally bell-shape or tubular shape with a thin wall. The sheath is formed of a rubber-like material, such as a commercially available resilient plastic. The plastic must be electrically insulating in nature. In addition, the plastic must be characterized by being sufficiently stiff to maintain its shape, but sufficiently resiliently collapsable and bendable for changing from its initial shape, and for resiliently returning to initial shape.

The sheath is provided with a closed end 16 having a central opening 17 surrounded by an exterior flange 18. Thus, the sheath may be stretched over the plug body with the wire 11 extending through the central opening 17 and the flange 18 of the sheath. The approximately tubular, closed end portion of the sheath resiliently grips against the plug body for tight frictional engagement therewith. Thus, the sheath is mounted upon the plug body with its open end portion extending generally parallel to the prongs for substantially the full length of the prongs.

The wall portion 19 surrounding the prongs may be tapered in cross-section for increasing its flexibility for radial spreading.

The open end or rim 20 of the tubular member is roughly in the plane which includes the free ends of the prongs 12, although the length relationship may vary slightly.

The resilient sheath normally accomodates itself to various size and shape plugs which are within approximately the same size as the sheath. Of course, different size and shape sheaths may be formed to accomodate different size plugs.

In use, the electrical plug is connected to a conventional wall-type receptacle 21 having prong receiving slots or openings 22. Common wall receptacles usually are formed in pairs, i.e., two receptacles arranged either side by side or one above the other. Each receptacle has two or three slots. The receptacle shown in the drawings is illustrated schematically as a single receptacle. Ordinarily, a face plate 23 is arranged upon the wall 24 within which the receptacle is located to cover the wall and the space between the wall and the receptacle and to provide a finished surface. Electrical wiring 25 located within the walls is connected to the receptacle.

When the plug prongs are inserted within the receptacle openings, contact is established for conducting electricity through the prongs, through the plug body connections to the wire 11 and thus, through the wire to the desired electrical device. Electrical energy begins to flow through the prongs before the prongs are fully inserted within their openings in a conventional plug-receptacle arrangement. Thus, for a short time exposed portions of the prongs are electrically energized. If contacted by the small fingers of a very young child, these exposed portions can cause a severe electrical shock or burn.

Figure 3:
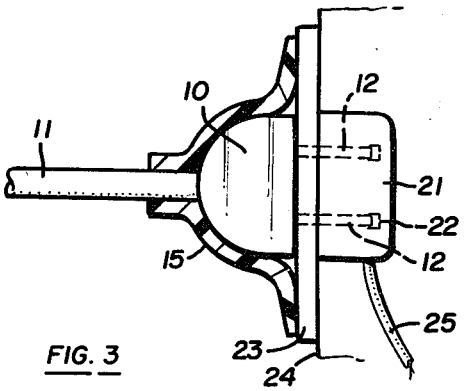
FIG. 3 illustrates the plug connected to a receptacle, with the sheath shown in cross-section.
Figure 4:
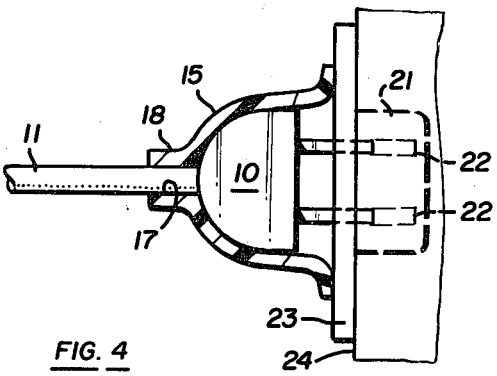
FIG. 4 is a view similar to FIG. 3, but showing the plug partially withdrawn from the electrical receptacle.

During the time that the prongs are inserted into the electrical receptacle slots, the sheath collapses endwise, as illustrated in FIGS. 3 and 4, by spreading or radially bending outwardly. Thus, a continuous barrier wall is maintained around the prongs to prevent access thereto. The tapered wall area near the rim 20 of the tubular member, permits easy bending and resilient flexing of the tubular members.

Conversely, when the plug is removed from the receptacle, the open end portion of the sheath gradually bends back into its normal shape, returning to initial shape upon complete removal of the prongs from the receptacle. During the time of removal, the prongs are protected by the barrier wall.

In cases where the electrical plug is loosely or partially inserted within the receptacle as frequently occurs with lamp and the like electrical connections in a private home, the partially exposed prongs are surrounded by the partially bent end portion of the tubular shaped sheath.

Figure 5:
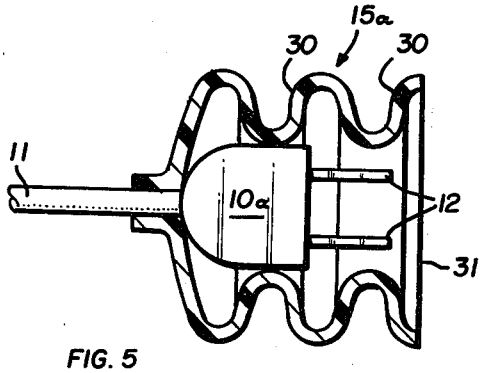
FIG. 5 illustrates a modification of the sheath, shown in cross-section, mounted upon a different shaped, conventional plug.
Figure 6:
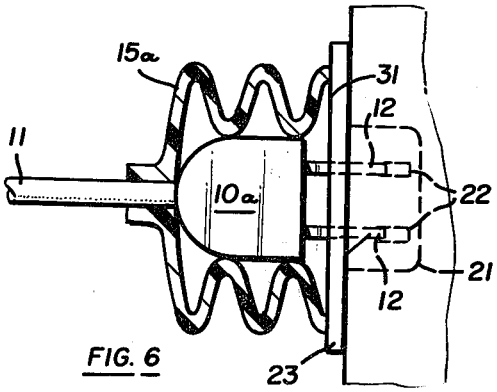
FIG. 6 is a view of the modification of FIG. 5, showing the plug partially inserted within a receptacle.

FIGS. 5 and 6 illustrate a modification wherein the plug body **10*a*** is shown in a slightly different, conventional shape, i.e., one that is flatter in one direction and elongated in length, that is, not completely semi-spherical. This is another conventional plug shape.

The modified sheath **15*a* is formed with annular pleats or corrugations 30 so that it is accordian-like in shape. Thus, when its edge or rim 31 engages against the surface of the face plate, the sheath collapses axially, in an accordian-like action. Conversely, it resiliently expands in an accordian-like fashion, axially, during removal of the plug from the receptacle. Thus, as illustrated in FIG. 6**, during partial insertion of the plug prongs within the receptacle slots, the partially exposed prongs are protected by the barrier wall against access.

Figure 7:
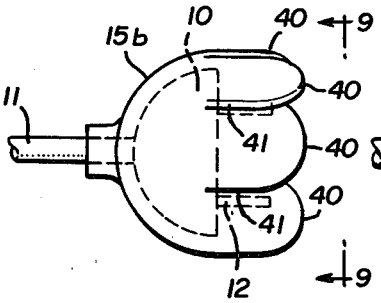
FIG. 7 illustrates a second modification wherein the sheath is formed with petal-like end sections.
Figure 8:
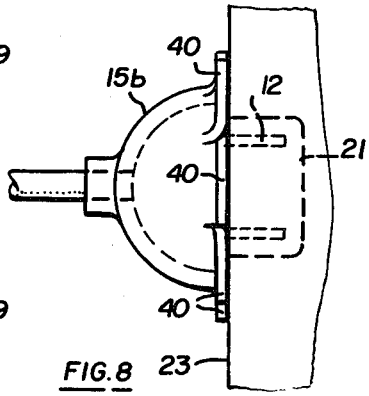
FIG. 8 illustrates the modification of FIG. 7, and shows the plug seated within a receptacle.
Figure 9:
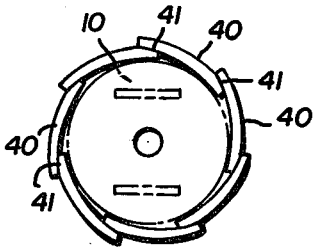
FIG. 9 is an end view, taken in the direction of arrows 9—9 of FIG. 7.

FIGS. 7–9 inclusive, illustrate a second modification wherein the sheath **15*b* is formed with a petal-like formation. Petals 40, are molded ina manner so as to overlap each other at their edges 41. Thus, the sheath resembles a flower and the petals may resiliently flex or bend radially outwardly upon pressure resulting from contact with the wall surface during insertion of the plug prongs into the receptacle, as illustrated in FIG. 8**. Because the petals overlap along their edges, a closed barrier wall is maintained at all times, that is, both during insertion and removal of the prongs from the receptacle.

Having fully described an operative embodiment of this invention, I now claim:

1. A child-proof protective sheath for a conventional electrical plug of the type having a plug body with an electrical wire extending into and connected within the body, and having electrical contact prongs extending from the body for insertion within corresponding openings formed in a wall-type receptacle, comprising:

a thin wall, generally tubular shaped member, formed of a resilient, rubber-like material, and being of a size to closely surround and engage the plug body adjacent the prongs for mounting upon the plug body, and for axially extending from the plug body for substantially the full length of the prongs to a free end, so as to encircle the prongs and form a protective wall which is spaced radially outwardly of the prongs;

said member being resiliently collapsable and extendable in its axial direction upon endwise pressure and release of endwise pressure, respectively, so that during the time that the plug prongs are inserted within and removed from the receptacle openings, the member completely encircles the space between the plug and receptacle to prevent child access to exposed portions of the prongs, and simultaneously the axial pressure between the contacting portion of the receptacle and the free end of the member results in endwise collapsing of the member during insertion of the prongs and the release of said pressure, during removal of the prongs from the openings, results in the member resiliently extending to its normal length, and the free end portion of said member at the prongs, being sufficiently resilient to spread radially outwardly in response to the pressure of contacting the receptacle during insertion of the prongs within the openings for thereby producing the axial collapse in length in the member;

said member including a roughly bell-shaped end to completely receive the plug body, and said bell-shaped end having a central opening through which the plug electrical wire extends, and said bell-shaped end tightly fits around and against the plug body for frictionally securing the member upon the plug body; and said member including a plurality of separate, petal-like sections each having opposed generally straight edges connected by a curved end, the edges of each petal-like section overlapping the edges of adjacent sections, and said petal-like sections radially bending and spreading during contact with the receptacle for forming a closed wall.

* * * * *